US006653777B1

(12) United States Patent
Onishi

(10) Patent No.: US 6,653,777 B1
(45) Date of Patent: Nov. 25, 2003

(54) IMAGE DISPLAY APPARATUS

(75) Inventor: Tomoya Onishi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 09/717,092

(22) Filed: Nov. 22, 2000

(30) Foreign Application Priority Data

Nov. 24, 1999 (JP) ..... 11-333254

(51) Int. Cl.[7] ..... H01J 1/62; H01J 63/04; H01J 1/54; H01J 1/68

(52) U.S. Cl. ..... 313/495; 313/496

(58) Field of Search ..... 313/495, 496, 313/466, 461, 512

(56) References Cited

U.S. PATENT DOCUMENTS 4,352,042 A * 9/1982 Lorenz et al. ..... 313/485
5,012,155 A * 4/1991 Datta et al. ..... 313/461
5,097,175 A * 3/1992 Thomas ..... 430/26
5,543,683 A * 8/1996 Haven et al. ..... 313/461
5,637,958 A * 6/1997 Levine ..... 313/496
5,760,538 A * 6/1998 Mitsutake et al. ..... 313/422
5,936,342 A * 8/1999 Ono et al. ..... 313/495
6,022,652 A * 2/2000 Haven et al. ..... 430/26

* cited by examiner

*Primary Examiner*—Ashok Patel
*Assistant Examiner*—Glenn D. Zimmerman
(74) *Attorney, Agent, or Firm*—Fitzpatrick, Cella, Harper & Scinto

(57) ABSTRACT

An image display apparatus has an image forming member in which a phosphor screen having a plurality of image forming areas is arranged, and a substrate arranged oppositely to the image forming member and having a plurality of electron-emitting devices for irradiating electrons to the image forming areas arranged on the substrate. The area of the region irradiated by the electrons is increased by inclining the image forming areas irradiated by the electrons.

22 Claims, 10 Drawing Sheets

IMAGE DISPLAY APPARATUS

BACKGROUND OF THE INVENTION

1. Field of the Invention

The present invention relates to an image display apparatus utilizing an electron beam irradiated to a phosphor screen, and can be applied to e.g., a field emission display (FED), a cathode ray tube (CRT) and the like.

2. Related Background Art

The large-sized structure of an image display apparatus such as a CRT is further required and vigorously researched. As the image display apparatus is large-sized, it is an important problem to make the image display apparatus thin and light weight and reduce cost of this image display apparatus.

However, in the CRT, an electron accelerated at high voltage is deflected by a deflecting electrode, and a phosphor on a face plate is excited. Therefore, when the CRT is large-sized, it is necessary to deepen the CRT in principle. Thus, it is difficult to provide the CRT which is thin and light weight. The inventors have made researches on a surface conduction electron-emitting device and an image display apparatus using this surface conduction electron-emitting device as an image display apparatus capable of solving the above problem.

For example, the inventors have applied, to a multi-electron beam source, an electric wiring method shown in FIG. 9 on trial. Namely, many surface conduction electron-emitting devices are two-dimensionally arranged, and are wired in a passive matrix shape as shown in FIG. 9 in the multi-electron beam source (field emission display (FED)).

In this FIG. 9, reference numerals 4001, 4002 and 4003 respectively designate surface conduction electron-emitting devices schematically shown, row-directional wirings and column-directional wirings. For convenience of drawing, 6×6 matrices are shown in FIG. 9, but matrix scale is not limited to that. Devices sufficient to display a desired image may be arranged and wired.

FIG. 10 shows the structure of a cathode ray tube using this multi-electron beam source. This cathode ray tube is constructed of an external container bottom 4005 (there is also a case in which this external container bottom is described as a rear plate) having the multi-electron beam source, an external container frame 4007, a face plate 4006 having a phosphor layer 4008, and a metal back 4009. A high voltage is applied to the metal back 4009 by a high voltage power source 4010 through a high voltage introducing terminal 4011.

A suitable electric signal is applied to the row-directional wirings 4002 and the column-directional wirings 4003 to output a desired electron beam in the multi-electron beam source in which the surface conduction electron-emitting devices are wired in the passive matrix.

For example, a selection voltage Vs is applied to the one of the row-directional wirings 4002 in a selected row so as to operate the surface conduction electron-emitting devices in an arbitrary one row in the matrix. Simultaneously, a non-selection voltage Vns is applied to other row-directional wirings 4002 in non-selection rows.

In synchronization with this application, a driving voltage Ve for outputting the electron beam is applied to the column-directional wirings 4003. In accordance with this method, a voltage of Ve-Vs is applied to the surface conduction electron-emitting devices in the selected row, and a voltage of Ve-Vns is applied to the surface conduction electron-emitting devices in the non-selection row.

If Ve, Vs and Vns are set to voltages of suitable magnitudes, the electron beam of a predetermined desirable intensity is outputted from only the surface conduction electron-emitting devices in the selected row. Further, if the different driving voltage Ve is applied to each of the column-directional wirings, the electron beam of a different intensity is outputted from each of the devices in the selected row.

A responsive speed of the surface conduction electron-emitting device is a high speed. Therefore, if a time for applying the driving voltage Ve is changed, a time for outputting the electron beam is also changed.

The electron beam outputted from the multi-electron beam source by the above voltage application is irradiated to the metal back 4009 to which a high voltage Va is applied. Thus, the phosphor as a target is excited and emits light. Accordingly, for example, an image display apparatus is formed if a voltage signal corresponding to image information is suitably applied.

The phosphor used in the face plate of the above image display apparatus has "luminance saturation characteristics" as described in "Phosphor Handbook." (edited by Phosphor Study Companion Society and published by OHMSHA on Jun. 20, 1991) (pp. 265 to 266).

Namely, when current density of the electron beam irradiated to the phosphor is increased, light emitting efficiency of the phosphor is reduced, and luminance is saturated even if the current density is increased.

As mentioned above, since the phosphor has the "luminance saturation characteristics", the following problems are caused.

In case a current value of the electron beam is increased to obtain high luminance in the image display apparatus, the light emitting efficiency is reduced by the "luminance saturation characteristics" and no luminance is improved as expected when the current density is increased.

It is confirmed that the phosphor is deteriorated in accordance with a supplied charge amount (coulomb amount) per unit area. In view of this point, it is also desirable to reduce the current density. In particular, the electron-emitting device of a transversal type such as the above surface conduction electron-emitting device, a field emission device (FE) or the like has a distribution of the high density current within one pixel irradiated by the electron beam as shown in FIG. 11. Accordingly, life shortening of the phosphor due to local deterioration of the phosphor in the highest density current portion becomes a serious problem. For example, the above one pixel in FIG. 3C is an area corresponding to the phosphor of each color shown by slanted lines between black matrices (shield members) 1010.

SUMMARY OF THE INVENTION

To solve the above problems of the prior art, an object of the present invention is to provide an image display apparatus in which the light emitting efficiency of a phosphor and luminance are improved.

Another object of the present invention is to provide an image display apparatus capable of improving luminance and obtaining a stable image for a long period by restraining local deterioration of the phosphor.

According to the present invention, there is provided an image display apparatus comprising an image forming member arranging a phosphor screen having a plurality of pixel areas therein, and a substrate arranged oppositely to the phosphor screen and arranging a plurality of electron-emitting devices therein, characterized in that each of the electron-emitting devices has a low potential side electrode and a high potential side electrode arranged side by side on the substrate, and an electron-emitting region located between both the electrodes, and each of the pixel areas has an inclination face inclined along a directed toward a center.

DESCRIPTION OF THE PREFERRED EMBODIMENTS

Figure 1:
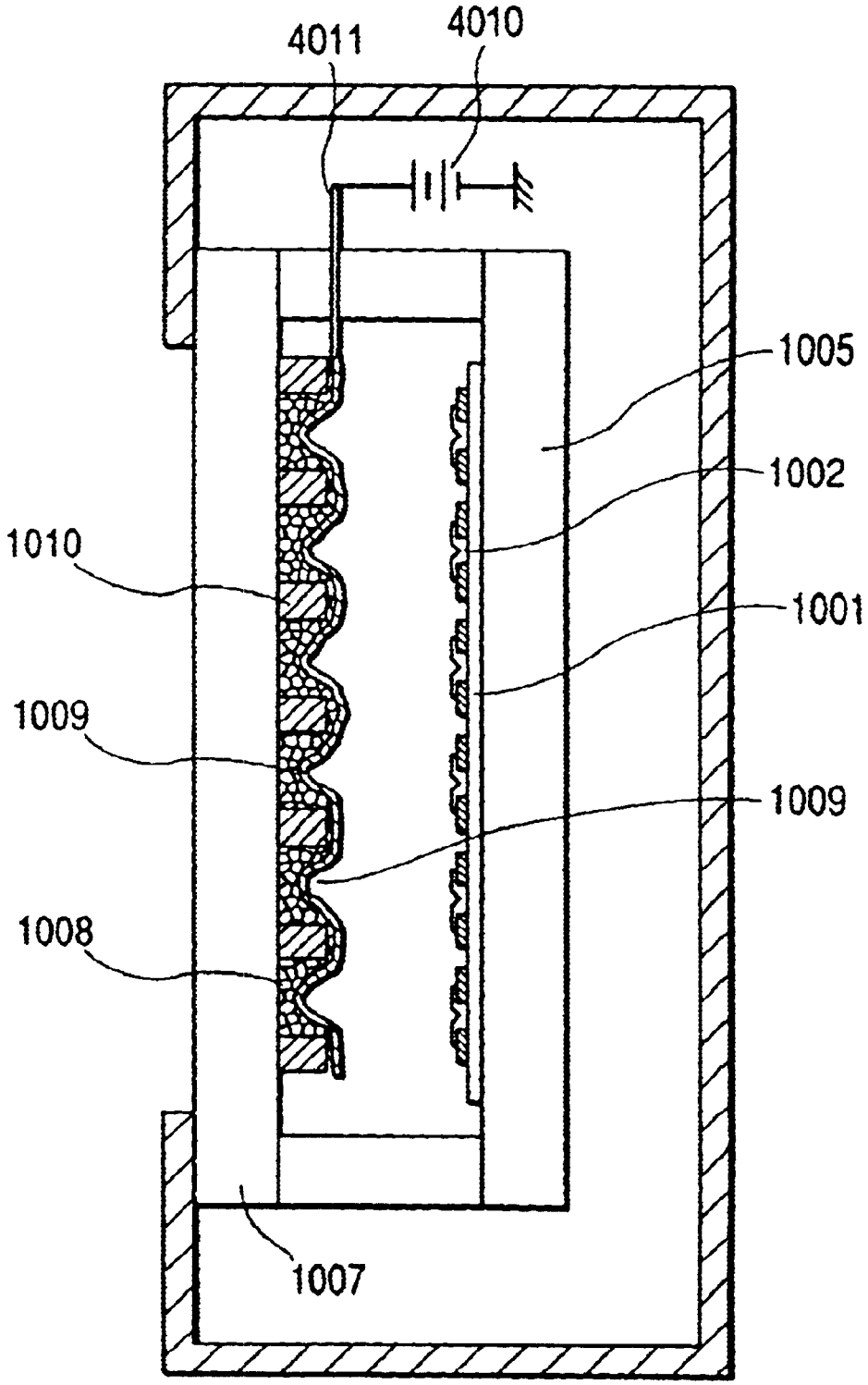
FIG. 1 is a schematically sectional view of an image display apparatus of a first embodiment.

According to the present invention, an image display apparatus comprising an image forming member in which a phosphor screen having a plurality of pixel areas are arranged therein, and a substrate arranged oppositely to the phosphor screen and having a plurality of electron-emitting devices arranged therein, is characterized in that each of the electron-emitting devices has a low potential side electrode and a high potential side electrode arranged side by side on the substrate, and an electron-emitting region located between both the electrodes, and each of the plurality of pixel areas has an inclination face inclined in a direction toward a center of the pixel area.

According to the present invention, an image display apparatus comprising an image forming member arranging a phosphor screen having a plural of pixel areas therein, and a substrate arranged oppositely to the phosphor screen and arranging a plurality of electron-emitting devices therein, is characterized in that each of the electron-emitting devices has a low potential side electrode and a high potential side electrode arranged side by side on the substrate, and an electron-emitting region located between the electrodes, and each of the plurality of pixel areas is formed in a concave shape and has an inclination face inclined along a direction toward a center of the pixel area.

In each of the above inventions, the electron-emitting device is preferably a surface conduction electron-emitting device which has the high potential side electrode and the low potential side electrode arranged side by side on the substrate, and also has an electroconductive film arranged between both the electrodes and having the electron-emitting region. Otherwise, the electron-emitting device is preferably a field emission device of a lateral type having an emitter electrode and a gate electrode arranged side by side on the substrate.

Further, according to the present invention, an image display apparatus comprising an image forming member arranging a phosphor screen having a plurality of pixel areas therein, and a substrate arranged oppositely to the above phosphor screen and arranging a plurality of electron-emitting devices therein is characterized in that each of the plurality of pixel areas is formed in a concave shape and has an inclination face inclined along a direction toward its center.

In the above invention, the electron-emitting device preferably has a pair of electrodes arranged side by side on the substrate, and also preferably has an electron-emitting region located between the pair of electrodes. For example, the electron-emitting device is preferably a surface conduction electron-emitting device which has a pair of electrodes arranged side by side on the substrate and also has an electroconductive film arranged between the pair of electrodes and having an electron-emitting region. Otherwise, the electron-emitting device is preferably a field emission device of a lateral type having an emitter electrode and a gate electrode arranged side by side on the substrate.

In the above inventions, the inclination face preferably has an angle not less than 30 degrees and less than 90 degrees with respect to the substrate.

Further, a phosphor arranged in each of the plurality of pixel areas preferably has a thickness varying within each of the pixel areas.

Further, the difference between the maximum and minimum values of a thickness of the phosphor is preferably twice or more the average diameter of a phosphor particle constituting the phosphor.

Further, a shield member is preferably arranged between the plurality of pixel areas.

According to the present invention, an image display apparatus comprising an image forming member having a phosphor screen divided into a plurality of pixel areas, and a substrate having means for emitting electrons to the phosphor screen, is characterized in that each of the pixel areas of the phosphor screen has a phosphor forming portion having a surface area larger than a projecting area seen from the side of the substrate.

The phosphor preferably has a portion forming an angle not less than 30 degrees and less than 90 degrees with respect to the substrate.

Each of the pixel areas of the phosphor screen preferably has a different thickness in the phosphor formed in one pixel area.

The difference in film thickness between the thickest and thinnest portions of the above phosphor is preferably set to be twice or more the average diameter of a phosphor particle constituting the phosphor.

The phosphor preferably has a concave shape.

It is also preferable that a shield member for dividing the phosphor screen into respective pixel areas is arranged in the image forming member, the shield member is thicker than an average thickness of the phosphor of the phosphor screen, and a side wall face portion of the shield member is covered with the phosphor.

It is also preferable that the shield member has an approximately parallel face portion opposed to the substrate, and also has a side wall face portion forming an angle not less than 30 degrees and less than 90 degrees with respect to the substrate, and the side wall face portion is covered with the phosphor.

The shield member preferably has a black portion in contact with the image forming member, and a white portion located on the black portion.

The phosphor preferably has a plurality of convex portions.

The phosphor screen is preferably formed by a screen printing method.

The phosphor of the phosphor screen is preferably formed by executing the screen printing method plural times.

A means for emitting electrons in a matrix shape is preferably arranged in the substrate.

The means for emitting electrons is preferably a surface conduction electron-emitting device.

The means for emitting electrons to the phosphor screen preferably has a cathode ray tube.

In the above construction, the pixel area in the phosphor forming portion irradiated by electrons on the phosphor screen becomes larger than the projecting area seen from the substrate side so that effective current density can be reduced. Accordingly, luminance of the image display apparatus can be improved by increasing light emitting efficiency, and local deterioration of the phosphor can be restrained.

Here, the phosphor screen means a film coated with the phosphor of powder. Further, here, the pixel area in a portion irradiated by electrons shows the area of a range up to a portion in which the current density is 1/10 times the highest current density in consideration of a current density distribution within one pixel.

The projecting area shows a sight area seen from a direction perpendicular to the image forming member.

Here, with respect to these areas, the phosphor used in the image display apparatus according to the present invention is generally composed of powder. Therefore, the actual phosphor screen has very fine irregularities, and its surface area is considerably large. However, it is here considered that the irregularities caused by the sizes of particles of the phosphor are neglected in the irradiating area and the projecting area. Concretely, the irregularities of a period smaller than an average particle diameter of the phosphor are averaged and set to be considered as a shape of the phosphor screen.

Since the phosphor forming portion has a portion forming an angle not less than 30 degrees and less than 90 degrees with respect to the substrate, an area irradiated by electrons can be increased and effective current density can be reduced. Accordingly, light emitting efficiency can be increased and luminance can be improved.

Here, as mentioned above, the phosphor is powder and microscopically has all angles with respect to a rear plate about an angle of the phosphor screen formed with respect to the substrate. However, similar to the above case, the irregularities of a period smaller than the average particle diameter of the phosphor are averaged and set to be considered as a shape of the screen.

Each of the pixel areas of the phosphor screen has a thickness varying in the phosphor forming portion formed in one pixel area. Thus, the area irradiated by electrons is increased and the effective current density can be relaxed. Accordingly, light emitting efficiency and luminance can be improved.

The difference in film thickness between the thickest and thinnest portions of the phosphor forming portion is twice or more an average particle diameter of the phosphor constituting the phosphor forming portion. Thus, the area irradiated by electrons can be increased and the effective current density can be relaxed. Accordingly, light emitting efficiency and luminance can be improved.

Since the phosphor forming portion has a concave shape, the area irradiated by electrons is increased and the effective current density can be relaxed. Therefore, light emitting efficiency can be increased and luminance can be improved.

A shield member for dividing the phosphor screen into each of pixel areas is arranged in the image forming member, the shield member is thicker than an average thickness of the phosphor forming portion of the phosphor screen, and a side wall face portion of the shield member is covered with the phosphor. Thus, the area irradiated by electrons is increased and the effective current density can be relaxed. Accordingly, light emitting efficiency can be increased and luminance can be improved.

The shield member has an approximately parallel face portion opposed to the substrate, and also has a side wall face portion forming an angle not less than 30 degrees and less than 90 degrees with respect to the substrate, and the side wall face portion is covered with the phosphor. Thus, the area irradiated by electrons is increased and the effective current density can be relaxed. Accordingly, light emitting efficiency can be increased and luminance can be improved.

Here, it is possible to suitably utilize a member having an opening portion in various forms such as a matrix shape, a stripe shape and the like as a form of the shield member.

An explanation of the side wall face portion covered with the phosphor will next be made. As mentioned above, if the shield member is thicker than the average thickness of the phosphor screen and the phosphor is attached to a portion higher than the average thickness of the phosphor screen seen from the image forming member, it is considered that the side wall face portion of the shield member is covered with the phosphor (The phosphor may be attached to an entire face of the side wall face portion, and may also be attached to the side wall face portion of a portion higher than the average thickness of the phosphor screen instead of this entire face. It may be further considered that the phosphor is attached until a portion of an upper face of the shield member over the side wall face portion.).

The shield member has the black portion in contact with the image forming member, and the white portion located on the black portion. Thus, light emitted from the phosphor covering the shield member is reflected on the white portion on the shield member. Therefore, light emitting efficiency can be improved.

Here, the black is set to be 10% or less in diffusion reflectivity and to have a light absorbing property, and the white is set to be not less than 70% in diffusion reflectivity.

Since the phosphor forming portion has plural convex portions, the area irradiated by electrons is increased and the effective current density can be relaxed. Therefore, light emitting efficiency and luminance can be improved.

Since the phosphor screen is formed by the screen printing method, the phosphor forming portion can be formed in a desired shape as mentioned above.

The phosphor forming portion of the phosphor screen can also be easily formed in a desired shape as mentioned above by executing the screen printing method plural times.

Preferred embodiments of the present invention will next be explained in detail as examples with reference to the drawings.

Embodiment 1

A first embodiment will be explained with reference to FIGS. 1 to 4.

Figure 3A:
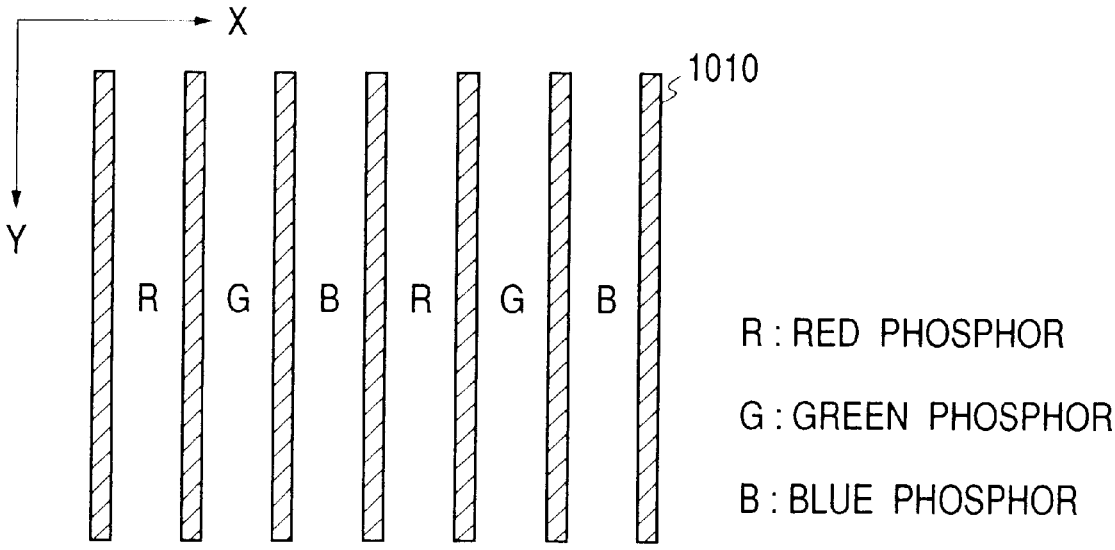
FIGS. 3A, 3B and 3C are views showing an arranging of phosphors on the fluorescent screen.
Figure 3B:
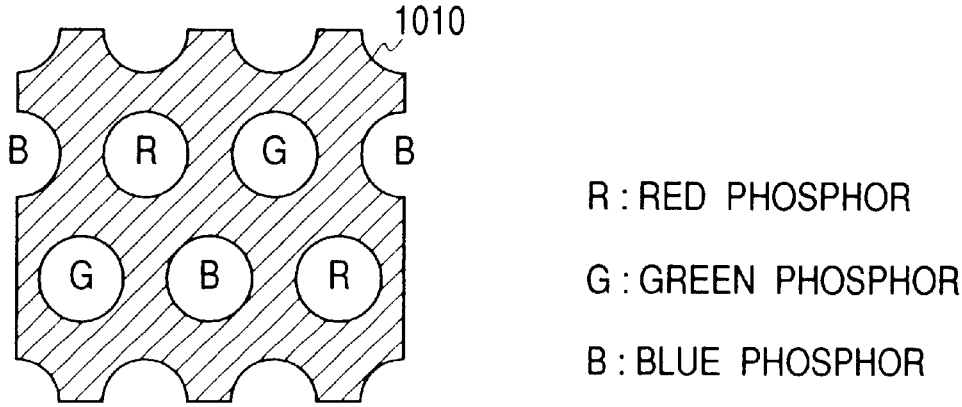
Figure 3C:
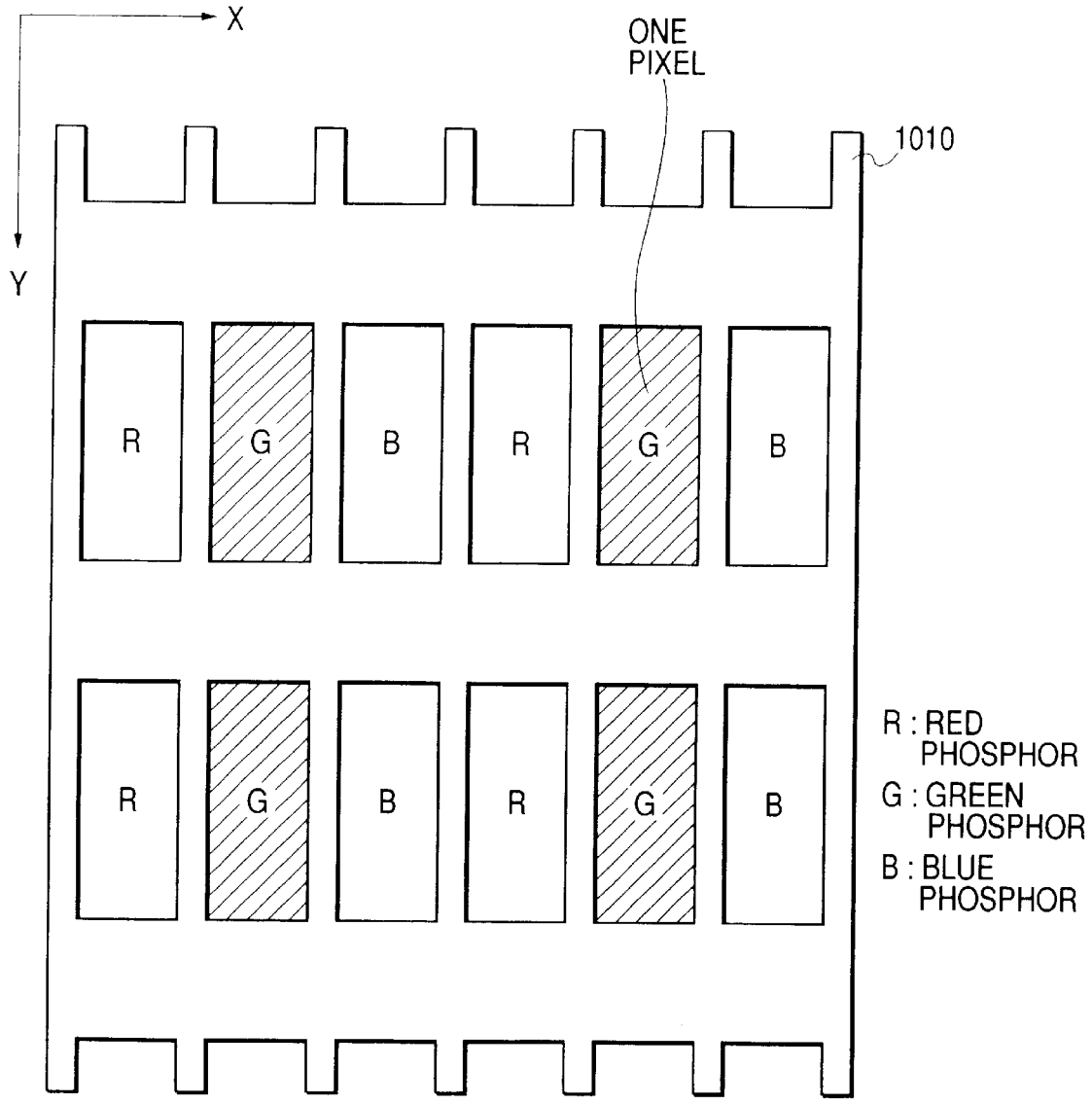

Soda lime glass (glass substrate) of 2.8 mm in thickness as an image forming member is cleaned and dried. Thereafter, as shown in FIG. 3C, a pattern having 720 stripes of 150 μm in width and 290 μm in pitch in a longitudinal direction and 240 stripes of 300 μm in width and 650 μm in pitch in a transversal direction is manufactured by a screen printing method by using a black pigment paste including a glass paste and a black pigment such that this pattern has 5 μm in thickness in the longitudinal and transversal directions. This pattern is set to a black matrix 1010 (the black matrix is a shield member such as a black electroconductive member or the like.).

The black matrix 1010 is arranged to prevent color mixing of a phosphor, and prevent the generation of a color shift even when a beam position is slightly shifted. The black matrix 1010 is also arranged to improve the contrast of an image by absorbing external light and for other reasons.

In this embodiment, the black matrix 1010 is manufactured by the screen printing method, but is not limited to this method. For example, the black matrix 1010 may also be manufactured by using a photolithography method, but is preferably manufactured by using the screen printing method in view of cost.

The black pigment paste including the glass paste and the black pigment is used as a material of the black matrix 1010. However, no material of the black matrix 1010 is limited to this black pigment paste. For example, carbon black or the like may also be used.

In this embodiment, as shown in FIG. 3C, the black matrix 1010 is manufactured in a matrix shape, but is not limited to this matrix shape. For example, the black matrix 1010 may also be arranged in a stripe shape, a delta shape, and other shapes (see FIGS. 3A and 3B).

Figure 2A:
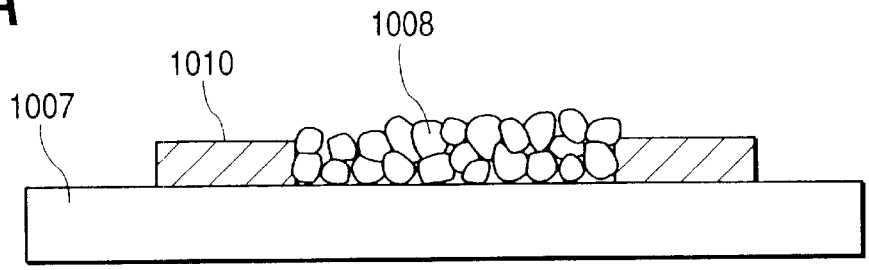
FIGS. 2A, 2B and 2C are schematically sectional views of a phosphor screen of the image display apparatus of the first embodiment.
Figure 2B:
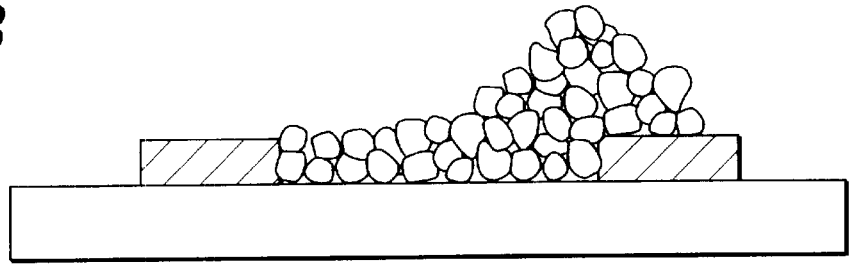
Figure 2C:
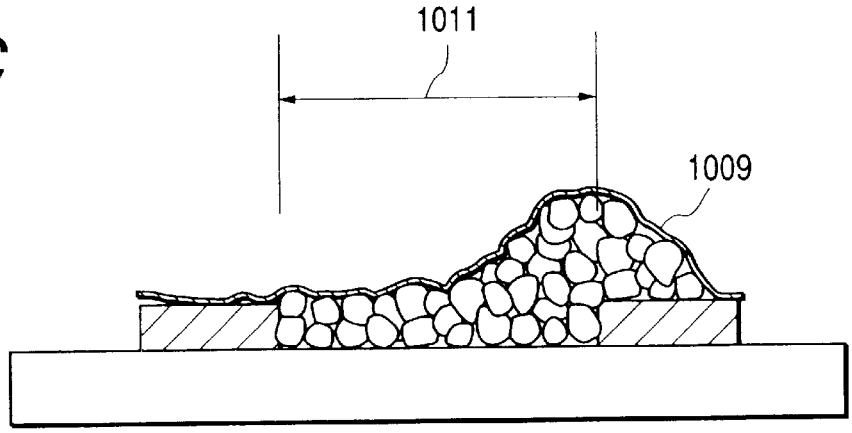

As shown in FIGS. 2A to 2C, an opening portion of the black matrix 1010 is set to a phosphor screen divided into plural pixel areas, and a phosphor forming portion 1008 is manufactured by the screen printing method using red, blue and green phosphors (phosphor paste).

Here, a forming procedure of the phosphor forming portion 1008 will be described.

First, as shown in FIG. 2A, a first phosphor layer is printed in the opening portion of the black matrix 1010. Thereafter, a second phosphor layer is printed as shown in FIG. 2B such that the first phosphor layer is overlapped with a portion of the second phosphor layer.

In this embodiment, the phosphor is set to a phosphor of P22 used in the field of a CRT. An average particle diameter of each of the red (P22-RE3; Y202S: Eu3+), blue (P22-B2; ZnS:Ag, Al), and green (P22-GN4; ZnS: Cu, Al) phosphors is set to 7.0 μm in median diameter Dmed, but is not limited to these phosphors. For example, other phosphors may also be used.

A resin intermediate film is manufactured by a filming process publicly known in the field of a cathode ray tube. Thereafter, a metallic evaporating film is manufactured, and the resin intermediate layer is finally thermally decomposed and removed. Thus, as shown in FIG. 2C, a metal back 1009 of 1000 Å in thickness is manufactured.

A film thickness distribution of the phosphor forming portion 1008 of a manufactured face plate 1007 is measured with respect to a certain one pixel area. In this measurement, the thinnest portion of the phosphor forming portion 1008 is 10.2 μm in thickness, and the thickest portion of the phosphor forming portion 1008 is 28.6 μm in thickness. Further, the phosphor surface of the highest current density portion has an inclination of about 30° with respect to a rear plate.

The face plate 1007 manufactured in this way is fixed to the rear plate 1005 as a substrate approximately in parallel therewith, and an image display apparatus is manufactured. Light emitting efficiency and luminance are respectively improved by 4% in comparison with an image display apparatus manufactured by using the face plate 1007 (see a comparison example described later) manufactured on the basis of the prior art. Local deterioration of the phosphor, i.e., deterioration of the phosphor in the highest current density portion is also improved. Thus, life of the phosphor can be extended by 15%.

Here, the phosphor life means a time reaching a state in which luminance is reduced by 30% due to advancement of the deterioration of the phosphor.

In the above embodiment, the time is measured until luminance is reduced by 30% while the image display apparatus is operated in a state in which driving Duty of a device is changed to 20 times in comparison with a normal display state and electrons are emitted 20 times in comparison with the normal state. This time was 115 hours in this embodiment while this time was 100 hours in the comparison example described later.

(Here, the driving Duty 20 times means is that, for example, the pulse width of a device driving voltage is set to 20 times the pulse width in the normal display state, and then, the image display apparatus is operated, and the like. Concretely, this driving Duty can be realized by operating each electron-emitting device at a pulse width of 20 millisec 20 times the normal pulse width of 1 millisec per 1 second in the display apparatus operated in a line sequence by 1000 scanning lines.)

Thus, it is expected that the phosphor life in the normal display state is 2300 hours in contrast to 2000 hours in the comparison example described later, and the display apparatus of the present invention can perform a display operation for 2300 hours.

The construction of a display panel of the image display apparatus to which the present invention is applied and its manufacturing method will be next explained by showing a concrete example.

Figure 4:
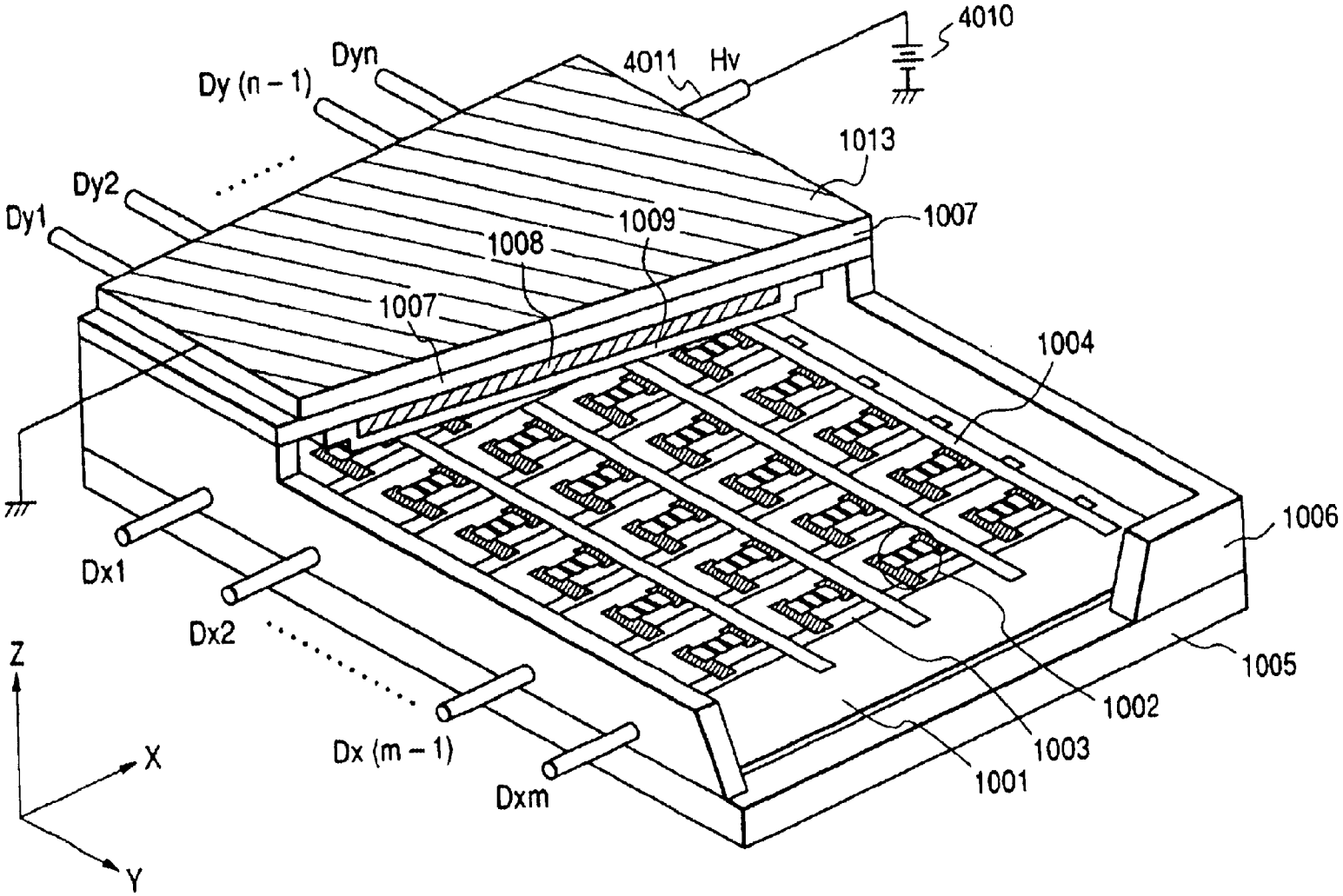
FIG. 4 is a perspective view of the image display apparatus of the embodiment in which one portion of the image display apparatus is notched.

FIG. 4 is a perspective view of the display panel used in the embodiment, and a portion of the panel is notched and shown to show an internal structure.

In this figure, reference numerals 1005, 1006 and 1007 respectively designate the external container bottom (there is also a case in which this external container bottom is described as rear plate), a side wall and a face plate. An airtight container for maintaining the interior of the display panel in a vacuum is formed by the rear plate 1005, the side wall 1006 and the face plate 1007.

When the airtight container is assembled, it is necessary to seal the airtight container so as to hold a sufficient strength and an airtight property in a joining portion of each member. For example, the joining portion is coated with frit glass, and this frit glass is burned for 10 minutes or more at a temperature from 400 to 500 degrees centigrade within the atmosphere or a nitrogen atmosphere so that the airtight container is sealed. A method for exhausting the interior of the airtight container in a vacuum will be described later.

Here, a substrate 1001 is fixed to the rear plate 1005. However, N×M surface conduction electron-emitting devices 1002 as means for emitting electrons are formed on the substrate 1001. (N and M are positive integers equal to or greater than 2, and are suitably set in accordance with the number of display pixels as objects. In this embodiment, N=720 and M=240 are set.) These N×M surface conduction electron-emitting devices are wired in a passive matrix by M-row-directional wirings 1003 and N-column-directional wirings 1004. A portion constructed of the substrate 1001 to the column-directional wirings 1004 is called a multi-electron beam source.

In this embodiment, the substrate 1001 of the multi-electron beam source is fixed to the rear plate 1005 of the airtight container. However, when the substrate 1001 of the multi-electron beam source has a sufficient strength, the substrate 1001 of the multi-electron beam source itself may also be used as the rear plate of the airtight container.

Dx1 to Dxm, Dy1 to Dyn and Hv designate terminals for the electric connection of an airtight structure arranged to electrically connect the display panel and an unillustrated electric circuit. Dx1 to Dxm are electrically connected to the row-directional wirings 1003 of the multi-electron beam source, and Dy1 to Dyn are electrically connected to the column-directional wirings 1004 of the multi-electron beam source. Hv is electrically connected to the metal back 1009 of the face plate.

To exhaust the interior of the airtight container in a vacuum, an unillustrated exhaust pipe and a vacuum pump are connected and the interior of the airtight container is exhausted until a vacuum degree of about $1.33\times10^{-5}$ (Pa) after the airtight container is assembled. Thereafter, the exhaust pipe is sealed. However, an unillustrated getter film is formed in a predetermined position within the airtight container to maintain the vacuum degree within the airtight container just before the sealing or after the sealing.

The getter film is a film formed by, for example, heating and evaporating a getter material having Ba as a main component by a heater or high frequency heating. The interior of the airtight container is maintained by an adsorbing action of the getter film in a vacuum degree from $1.33\times10^{-3}$ to $1.33\times10^{-5}$ (Pa).

The basic construction of the display panel in this embodiment of the present invention and its manufacturing method have thus been explained.

Next, the multi-electron beam source used in the display panel in the above embodiment will be explained. In the multi-electron beam source used in the image display apparatus of the present invention, a material, a shape or a manufacturing method of the surface conduction electron-emitting device is not limited if this multi-electron beam source is an electron source having surface conduction electron-emitting devices wired in a passive matrix.

However, the inventors have found that the surface conduction electron-emitting device having an electron-emitting region or its peripheral portion formed of a particulate film has excellent electron-emitting characteristics, and is easily manufactured.

Accordingly, it can be said that this surface conduction electron-emitting device is most suitable for use of the multi-electron beam source of the image display apparatus of high luminance and a large-sized screen.

Therefore, the surface conduction electron-emitting device having the electron-emitting region or its peripheral portion formed of a particulate film is used in the display panel in the above embodiment.

Note that a cathode ray tube or the like can also be used as a means for emitting electrons instead of the surface conduction electron-emitting device.

Embodiment 2

Figure 5A:
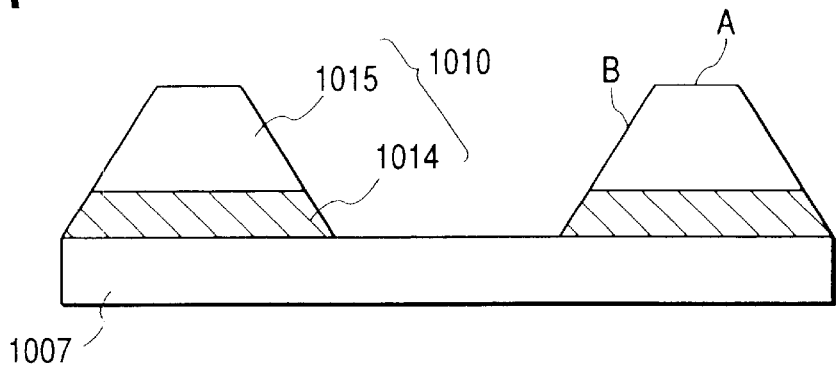
FIG. 5A, 5B and 5C are schematically sectional views of a phosphor screen of an image display apparatus of a second embodiment.
Figure 5B:
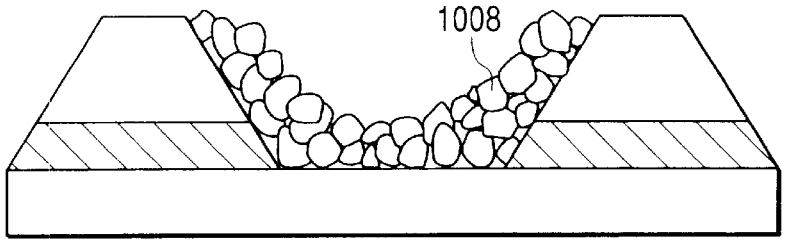

A second embodiment will next be explained with reference to FIGS. 5A to 5C.

Similar to the first embodiment, a black matrix 1010 is manufactured on soda lime glass of 2.8 mm in thickness by a screen printing method. Here, a black pigment paste including a glass paste and a black pigment is firstly printed, and a pattern having 720 stripes of 150 μm in width and 290 μm in pitch in a longitudinal direction and 240 stripes of 300 μm in width and 650 μm in pitch in a transversal direction is manufactured by the screen printing method such that this pattern has 5 μm in thickness in the longitudinal and transversal directions. A black layer 1014 is manufactured by this pattern.

A substance obtained by dispersing the glass paste and particulates of alumina to a resin binder is screen-printed five times on the manufactured black layer 1014, and a white layer 1015 of the black matrix 1010 is manufactured. In each printing, the substance is printed in a pattern thinner than that at the previous printing time.

A shape of the manufactured black matrix 1010 is observed by a scan type electron microscope, and a film thickness and the like are measured by a tracer type surface roughness tester. As a result, this shape is formed as shown in FIG. 5A, and a face A is approximately parallel to a face plate 1007, and the angle of a face B formed with respect to the face plate 1007 is about 40 degrees. The thickness of the thickest portion of the black matrix 1014 is 32.3 μm.

Figure 5C:
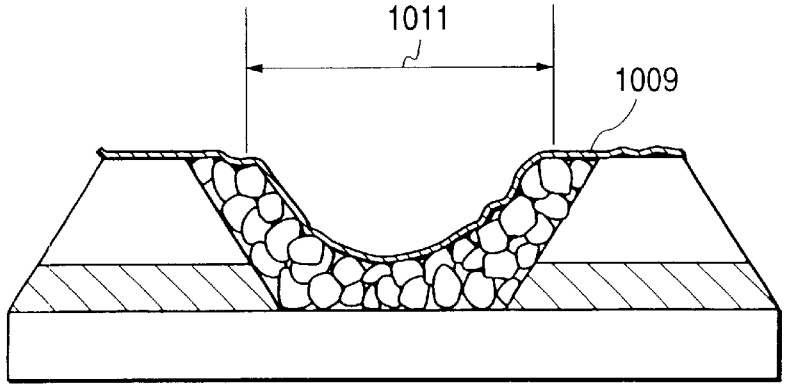

Next, a phosphor is printed in an opening portion of the black matrix 1010 (FIG. 5B), and a metal back 1009 is manufactured by the filming process (FIG. 5C). When a manufactured phosphor forming portion 1008 is observed and measured, a central portion within one pixel area has a concave shape, and there is a portion in which the angle between the central portion and a rear plate 1005 is about 40 degrees. Further, a film thickness of the phosphor forming portion 1008 in the central portion is 15.7 μm.

The face plate 1007 manufactured in this way is fixed to the rear plate 1005 approximately in parallel therewith, and an image display apparatus is manufactured. Light emitting efficiency and luminance are respectively improved by 12% in comparison with the image display apparatus manufactured by using the conventional face plate 1007. Further, life of the phosphor can be extended by 30% by improving local deterioration of the phosphor.

Embodiment 3

Figure 6:
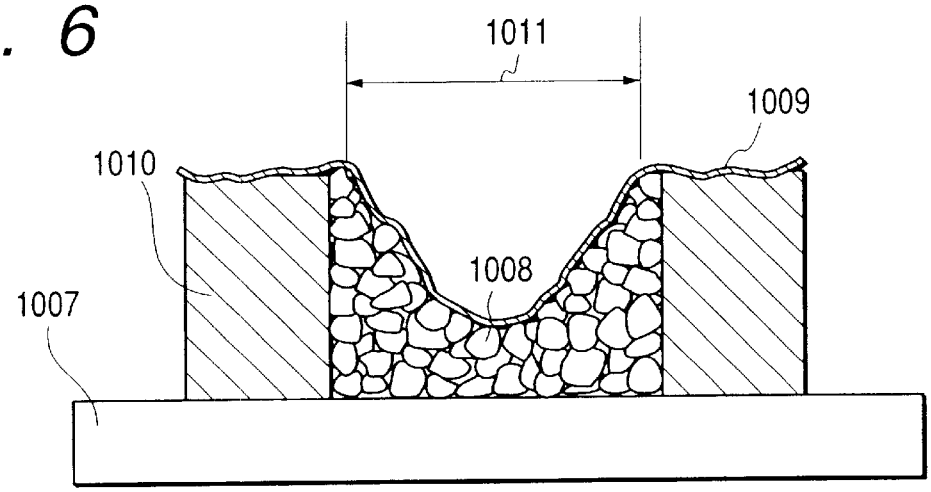
FIG. 6 is a schematically sectional view of a phosphor screen of an image display apparatus of a third embodiment.

A third embodiment will next be explained with reference to FIG. 6.

Similar to the first embodiment, a black matrix 1010 is formed on soda lime glass of 2.8 mm in thickness by a screen printing method. A pattern having 720 stripes of 180 μm in width and 290 μm in pitch in a longitudinal direction and 240 stripes of 300 μm in width and 650 μm in pitch in a transversal direction is manufactured in this matrix. Here, the black matrix 1010 is printed 8 times, and a measured thickness of the manufactured black matrix 1010 is 43.6 μm.

Here, a black pigment paste is used in each of the eight printings as a material of the black matrix 1010 in the screen printing, but this material is not limited to the black pigment paste. For example, if the black pigment paste is used in only a first one layer and a white material such as alumina or the like is used in subsequent layers, light of a phosphor can be efficiently taken out on an observer side without being absorbed on a wall face.

Next, the phosphor is printed in an opening portion of the black matrix 1010, and a metal back 1009 is manufactured by the filming process. When a manufactured phosphor forming portion 1008 is observed and measured, the phosphor forming portion 1008 has a structure as shown in FIG. 6. A central portion within one pixel area has a concave shape, and there is a portion in which the angle between the central portion and a rear plate 1005 is about 60 degrees. A film thickness of the phosphor forming portion 1008 in the central portion is 12.9 μm.

A face plate 1007 manufactured in this way is fixed to the rear plate 1005 approximately in parallel therewith, and an image display apparatus is manufactured. Light emitting efficiency and luminance are respectively improved by 17% in comparison with the image display apparatus manufactured by using the conventional face plate 1007. Further, life of the phosphor can be extended about twice by improving local deterioration of the phosphor.

Embodiment 4

A fourth embodiment will next be explained with reference to FIG. 7.

Similar to the first embodiment, a pattern having 720 stripes of 100 μm in width and 290 μm in pitch in a longitudinal direction and 240 stripes of 300 μm in width and 650 μm in pitch in a transversal direction is manufactured on soda lime glass of 2.8 mm in thickness by the screen printing method using a black pigment paste such that this pattern has 5 μm in thickness in the longitudinal and transversal directions. This pattern is set to a black matrix 1010.

Next, a phosphor is screen-printed in an opening portion of the black matrix 1010 so that a phosphor forming portion 1008 is formed. Here, a forming method of the phosphor forming portion 1008 will be explained.

First, a first phosphor layer is printed in the opening portion of the black matrix 1010. Thereafter, a second phosphor layer is printed such that plural convex shapes are formed on the first phosphor layer. In this embodiment, the screen printing is performed twice, but is not limited to this case. If the plural convex shapes are formed on the phosphor forming portion 1008, an object of the present invention can be achieved.

Figure 7:
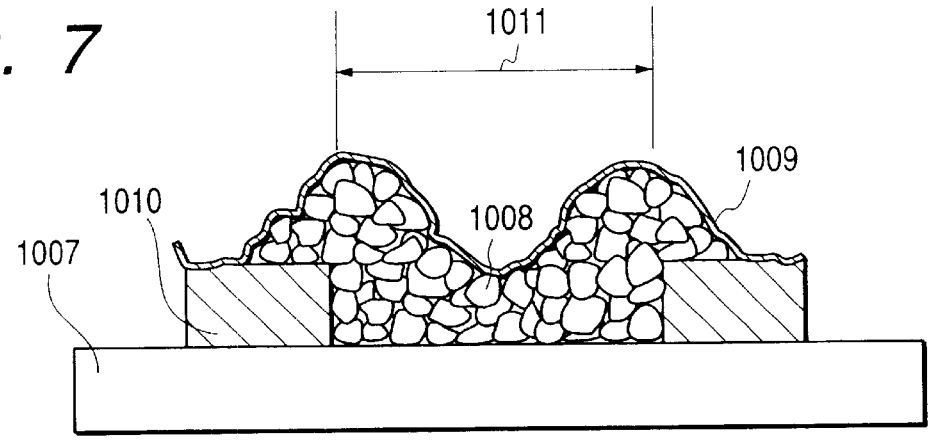
FIG. 7 is a schematically sectional view of a phosphor screen of an image display apparatus of a fourth embodiment.

When the manufactured phosphor forming portion 1008 is observed and measured, the phosphor forming portion 1008 has a structure shown in FIG. 7, and the plural convex shapes exist on the phosphor forming portion 1008 within one pixel area. The thinnest portion of the phosphor forming portion 1008 has 13.9 μm in film thickness, and the thickest portion of the phosphor forming portion 1008 has 29.1 μm in film thickness. The phosphor surface of the highest current density portion has an inclination of about 30 degrees with respect to a rear plate.

A face plate 1007 manufactured in this way is fixed to the rear plate 1005 approximately in parallel therewith, and an image display apparatus is manufactured. Light emitting efficiency and luminance are respectively improved by 9% in comparison with the image display apparatus manufactured by using the conventional face plate 1007. Further, local life of the phosphor can be extended by 15%.

Comparison Example

Figure 8:
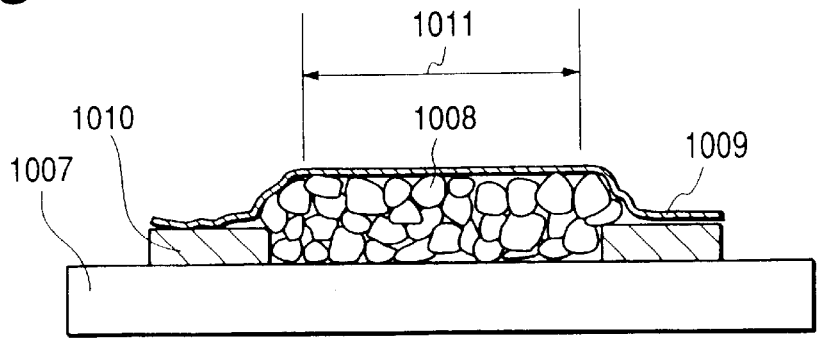
FIG. 8 is a schematically sectional view of a phosphor screen of an image display apparatus as a comparison example.
Figure 9:
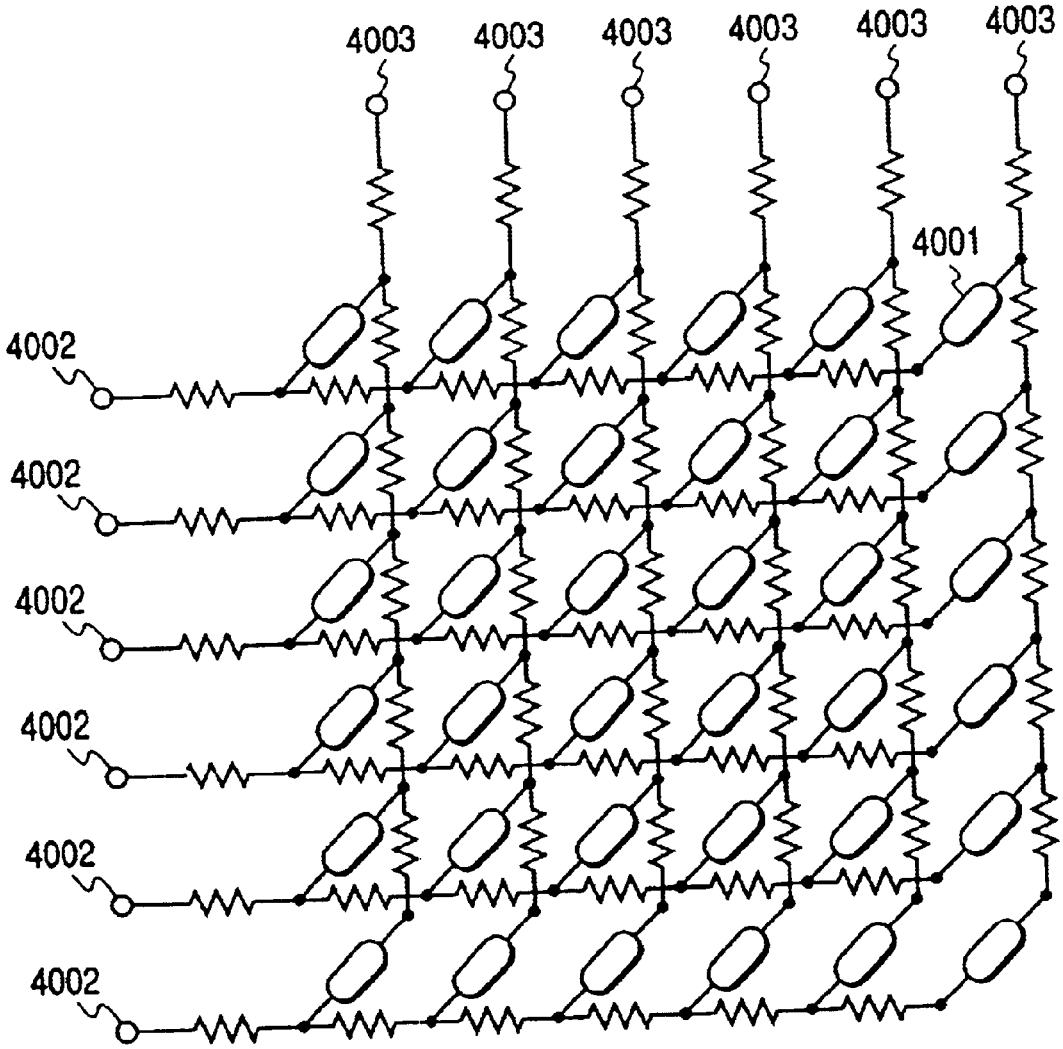
FIG. 9 PRIOR ART
FIG. 9 is a view showing a state such that a surface conduction electron-emitting device is connected in matrix wiring.
Figure 10:
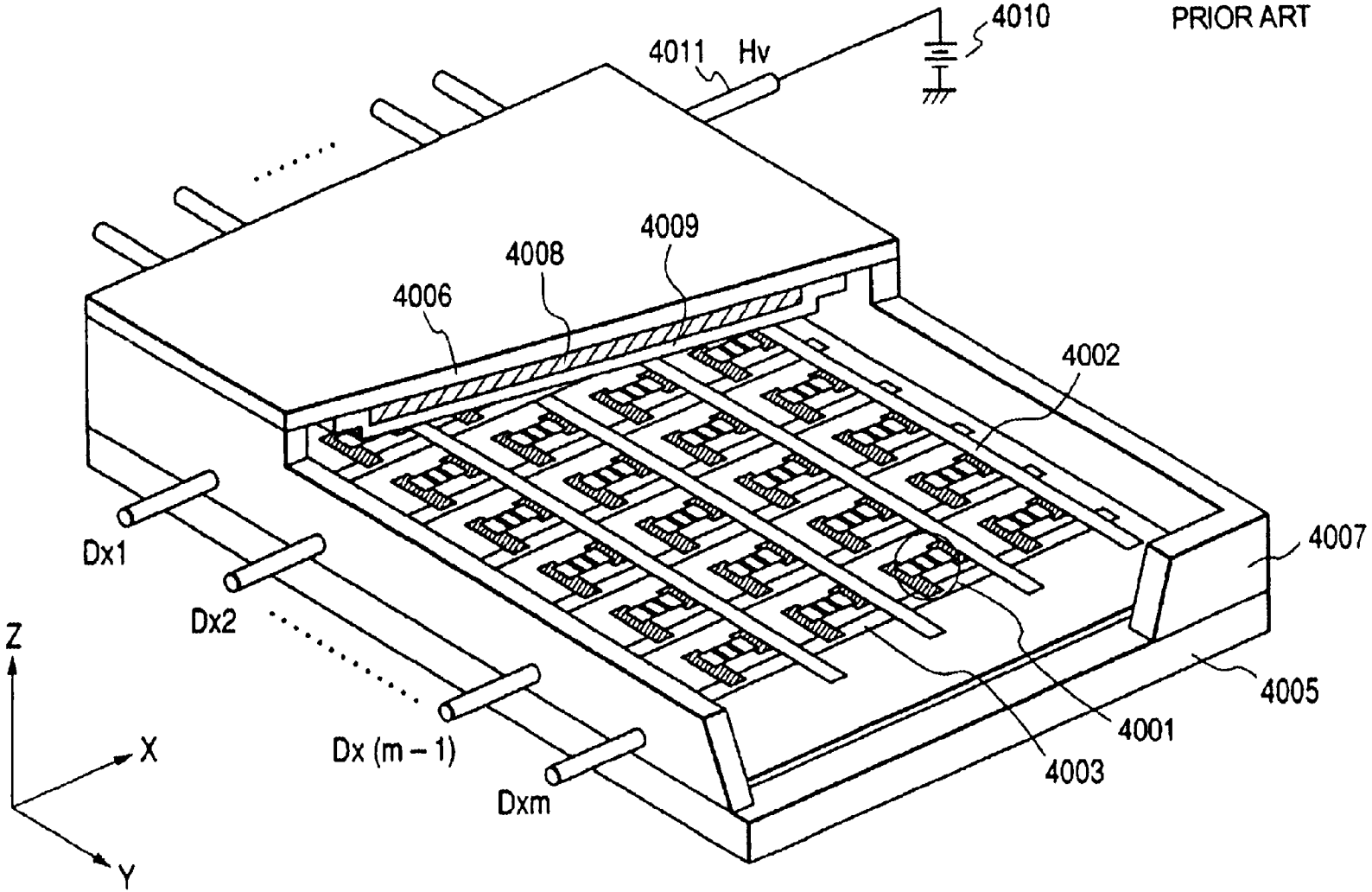
FIG. 10 PRIOR ART
FIG. 10 is a perspective view showing a conventional image display apparatus in which one portion of the conventional image display apparatus is notched.
Figure 11:
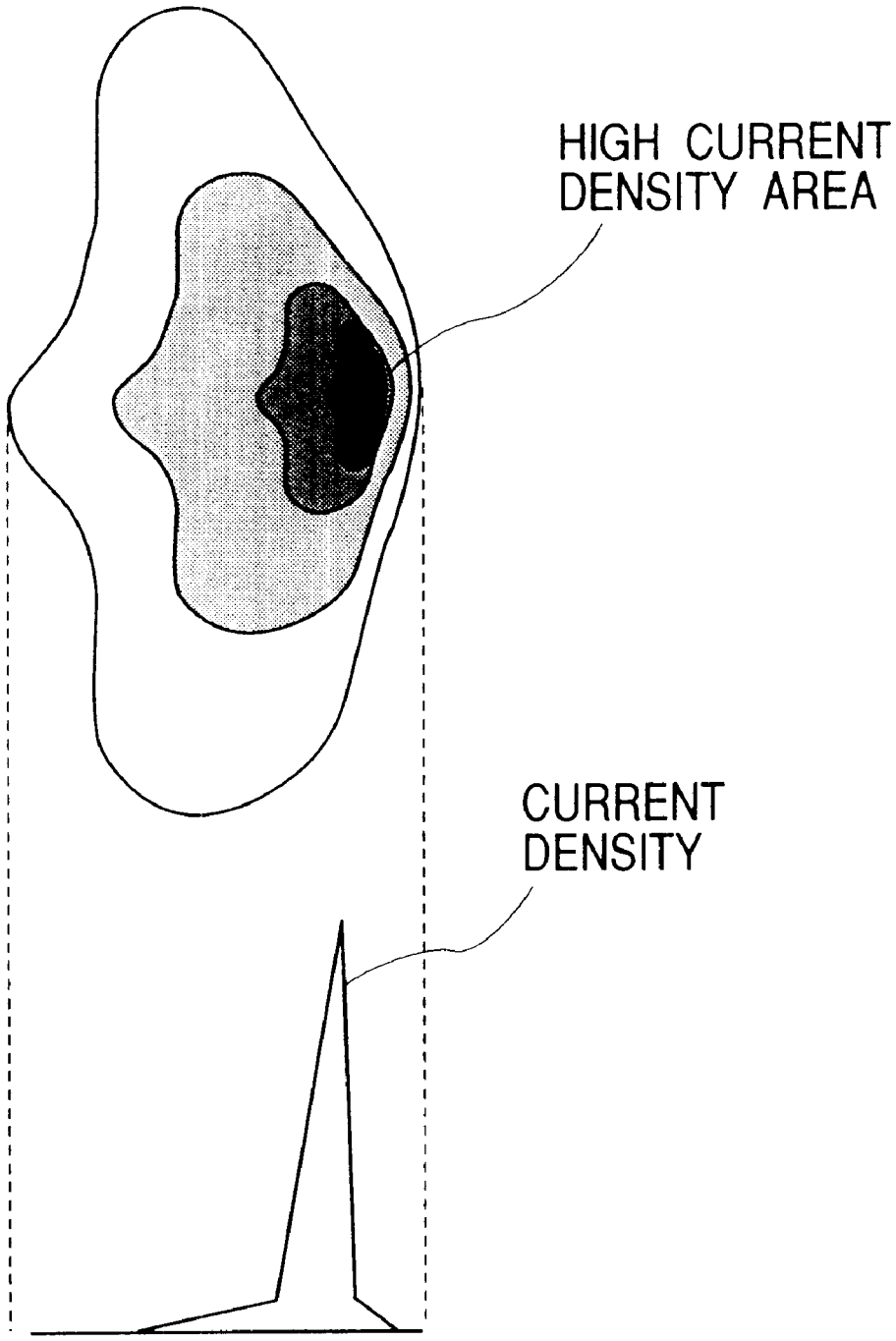
FIG. 11 is a view showing one example of a current density distribution within one pixel.

A comparison example of the present invention will next be explained with reference to FIG. 8.

Similar to the first embodiment, a pattern having 720 stripes of 100 μm in width and 290 μm in pitch in a longitudinal direction and 240 stripes of 300 μm in width and 650 μm in pitch in a transversal direction is manufactured on soda lime glass of 2.8 mm in thickness by the screen printing method using a black pigment paste such that this pattern has 5 μm in thickness in the longitudinal and transversal directions. This pattern is set to a black matrix 1010.

Next, a phosphor is printed in an opening portion of the black matrix 1010, and a metal back 1009 is manufactured by the filming process. When a manufactured phosphor forming portion 1008 is observed and measured, the phosphor forming portion 1008 has a structure shown in FIG. 8. An area 1011 (this area is an electron beam irradiating area 1011 and a corresponding area also exists in each of phosphor screens of FIGS. 2A to 2C, 5A to 5C, 6 and 7) irradiated by electrons within one pixel area is approximately flat except for irregularities caused by the size of a phosphor particle, and the phosphor has 18.4 μm in film thickness.

A face plate 1007 manufactured in this way is fixed to a rear plate 1005 approximately in parallel therewith, and an image display apparatus is manufactured and set to a comparison example of the image display apparatus of the present invention.

According to the present invention explained above, an area of the phosphor screen irradiated by electrons is increased, and the current density of an electron beam is effectively reduced in the image display apparatus having the phosphor screen for exciting the phosphor by the electron beam and emitting light. Thus, light emitting efficiency of the phosphor can be increased and luminance of the image display apparatus can be improved.

What is claimed is:

1. An image display apparatus comprising an image forming member in which arranging a phosphor screen having a plurality of pixel areas are arranged therein, and a substrate arranged oppositely to said phosphor screen and having a plurality of electron-emitting devices arranged thereon, wherein each of said electron-emitting devices has a low potential side electrode and a high potential side electrode arranged side by side on said substrate, and an electron-emitting region located between both the electrodes, and each of said plurality of pixel areas is formed in a concave shape and has a face inclined along a direction toward a center of the pixel area.

2. An image display apparatus according to claim 1, wherein said electron-emitting device is a surface conduction electron-emitting device which has the high potential side electrode and the low potential side electrode arranged side by side on said substrate, and also has an electroconductive film arranged between the electrodes and having the electron-emitting region.

3. An image display apparatus according to claim 1, wherein said electron-emitting device is a field emission device of a lateral type having an emitter electrode and a gate electrode arranged side by side on said substrate.

4. An image display apparatus comprising an image forming member in which a phosphor screen having a plurality of pixel areas arranged therein, and a substrate arranged oppositely to said phosphor screen and having a plurality of electron-emitting devices arranged thereon, wherein each of said plurality of pixel areas is formed in a concave shape and has a face inclined along a direction toward a center of the concave.

5. An image display apparatus according to claim 4, wherein said electron-emitting device has a pair of electrodes arranged side by side on said substrate, and also has an electron-emitting region located between the pair of electrodes.

6. An image display apparatus according to claim 4, wherein said electron-emitting device is a surface conduction electron-emitting device which has a pair of electrodes arranged side by side on said substrate and also has an electroconductive film arranged between the pair of electrodes and having an electron-emitting region.

7. An image display apparatus according to claim 4, wherein said electron-emitting device is a field emission device of a lateral type having an emitter electrode and a gate electrode arranged side by side on said substrate.

8. An image display apparatus according to any one of claims 1 or 4, wherein said inclination face is inclined at an angle of not less than 30 degrees and less than 90 degrees to said substrate.

9. An image display apparatus according to any one of claims 1 or 4, wherein a phosphor arranged in each of said plurality of pixel areas has a thickness varying within each pixel area.

10. An image display apparatus according to any one of claims 1 or 4, wherein a difference between maximum and minimum values of a thickness of said phosphor is twice or more an average diameter of a phosphor particle constituting said phosphor.

11. An image display apparatus according to any one of claims 1 or 4, wherein a shield member is arranged between said plurality of pixel areas.

12. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein said phosphor has a concave shape.

13. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein a shield member for dividing said phosphor screen into respective the pixel areas is arranged in said image forming member, said shield member is thicker than the average thickness of a phosphor forming portion of said phosphor screen, and a side wall face portion of said shield member is covered with said phosphor, and wherein said shield member has an approximately parallel face portion opposed to said substrate, and the side wall face portion arranged at an angle not less than 30 degrees and less than 90 degrees to said substrate, and said side wall face portion is covered with said phosphor.

14. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein a shield member for dividing said phosphor screen into respective the pixel areas is arranged in said image forming member, said shield member is thicker than the average thickness of a phosphor forming portion of said phosphor screen, and a side wall face portion of said shield member is covered with said phosphor, and wherein said shield member has a black portion in contact with said image forming member, and a white portion located on this black portion.

15. An image display apparatus comprising an image forming member in which arranging a phosphor screen having a plurality of pixel areas are arranged therein, and a substrate arranged oppositely to said phosphor screen and having a plurality of electron-emitting devices arranged thereon, wherein each of said electron-emitting devices has a low potential side electrode and a high potential side electrode arranged side by side on said substrate, and an electron-emitting region located between both the electrodes, and each of said plurality of pixel areas is formed in a concave shape and has a face inclined.

16. An image display apparatus comprising an image forming member in which a phosphor screen having a plurality of pixel areas arranged therein, and a substrate arranged oppositely to said phosphor screen and having a plurality of electron-emitting devices arranged thereon, wherein each of said plurality of pixel areas is formed in a concave shape and has a face inclined.

17. An image display apparatus according to claim 15 or 16, wherein said face is inclined at an angle of not less than 30 degrees and less than 90 degrees to said substrate.

18. An image display apparatus according to claim 15 or 16, wherein a phosphor arranged in each of said plurality of pixel areas has a thickness varying within each pixel area.

19. An image display apparatus according to claim 15 or 16, wherein a difference between maximum and minimum values of a thickness of said phosphor is twice or more than an average diameter of a phosphor particle constituting said phosphor.

20. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein said phosphor has a portion forming an angle not less than 30 degrees and less than 90 degrees with respect to said substrate, and wherein said phosphor has a concave shape.

21. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein said phosphor has a portion forming an angle not less than 30 degrees and less than 90 degrees with respect to said substrate, wherein a shield member for dividing said phosphor screen into respective the pixel areas is arranged in said image forming member, said shield member is thicker than the average thickness of a phosphor forming portion of said phosphor screen, and a side wall face portion of said shield member is covered with said phosphor, and wherein said shield member has an approximately parallel face portion opposed to said substrate, and the side wall face portion arranged at an angle not less than 30 degrees and less than 90 degrees to said substrate, and said side wall face portion is covered with said phosphor.

22. An image display apparatus comprising an image forming member having a phosphor screen divided into plural pixel areas, and a substrate having means for emitting electrons to said phosphor screen, wherein each of the pixel areas of said phosphor screen has a phosphor having a surface area larger than a projecting area seen from the side of said substrate, wherein said phosphor has a portion forming an angle not less than 30 degrees and less than 90 degrees with respect to said substrate, wherein a shield member for dividing said phosphor screen into respective the pixel areas is arranged in said image forming member, said shield member is thicker than the average thickness of a phosphor forming portion of said phosphor screen, and a side wall face portion of said shield member is covered with said phosphor, and wherein said shield member has a black portion in contact with said image forming member, and a white portion located on this black portion.

* * * * *